US008684715B2

(12) United States Patent
Stegmair et al.

(10) Patent No.: US 8,684,715 B2
(45) Date of Patent: Apr. 1, 2014

(54) VANE MACHINE

(76) Inventors: Michael Stegmair, Aichach-Untermauerbach (DE); Daniel Stegmair, Aichach-Untermauerbach (DE)

( * ) Notice: Subject to any disclaimer, the term of this patent is extended or adjusted under 35 U.S.C. 154(b) by 877 days.

(21) Appl. No.: 12/600,760

(22) PCT Filed: May 28, 2007

(86) PCT No.: PCT/IB2007/051998
§ 371 (c)(1),
(2), (4) Date: Nov. 18, 2009

(87) PCT Pub. No.: WO2008/146094
PCT Pub. Date: Dec. 4, 2008

(65) Prior Publication Data

US 2010/0158740 A1 Jun. 24, 2010

(51) Int. Cl.
*F03C 2/00* (2006.01)
*F03C 4/00* (2006.01)
*F04C 2/00* (2006.01)

(52) U.S. Cl.
USPC ..... 418/262; 418/210; 418/255; 418/266

(58) Field of Classification Search
USPC ..... 418/255, 262, 266–268, 209–210
See application file for complete search history.

(56) References Cited

U.S. PATENT DOCUMENTS

| | | | |
|---|---|---|---|
| 2,463,155 | A | 3/1949 | Dawes |
| 4,149,833 | A | 4/1979 | Baudin |
| 4,389,173 | A | 6/1983 | Kite |
| 5,385,458 | A | 1/1995 | Chu |
| 6,226,986 | B1 | 5/2001 | Driver et al. |

FOREIGN PATENT DOCUMENTS

| | | | |
|---|---|---|---|
| DE | 20117224 | U1 | 12/2001 |
| DE | 10227234 | A1 | 1/2004 |
| JP | 54055804 | A | 5/1979 |
| JP | 11506518 | T | 6/1999 |
| JP | 2002516942 | A | 6/2002 |
| WO | 9961752 | A1 | 12/1999 |
| WO | 03036047 | A1 | 5/2003 |
| WO | 2006042196 | A2 | 4/2006 |

*Primary Examiner* — Theresa Trieu
(74) *Attorney, Agent, or Firm* — Laurence A. Greenberg; Werner H. Stemer; Ralph E. Locher

(57) ABSTRACT

A vane machine for expansion or compression of gases, air, engine exhaust, vapors or a mixture thereof, includes a housing with a cylindrical space having inlet and outlet ports, a shaft offset in parallel or eccentric relative to a central housing axis and first and second circular discs on the shaft mutually offset in parallel. Slides are guided by the circular discs and displaceable in direction of an inner housing wall. Vane cells are formed by two neighboring slides and an adjoining region of the wall and volumes of the vane cells in vicinity of the inlet and outlet ports differ. To obtain reliability and efficiency, each circular disc has a plurality of circular arcuate slots, each slide can have a circular arc shape on an end facing the housing, and the circular arcuate part of each slide moves into circular arcuate slots of first and second circular discs.

6 Claims, 7 Drawing Sheets

VANE MACHINE

BACKGROUND OF THE INVENTION

Field of the Invention

The invention relates to a vane machine for the expansion or compression of gaseous media, such as air, exhaust gases from an internal combustion engine, vaporous media or a mixture thereof.

A vane machine is known from DE 201 17 224 U1. So that the expansion profile can be better adapted to thermal requirements and so that a vane machine can be produced with low production costs, a vane machine with vane cell units is proposed, which has cell volumes increasing and decreasing in size in the direction of rotation.

BRIEF SUMMARY OF THE INVENTION

The object on which the invention is based is to specify a reliable and efficient vane machine.

This object is achieved by means of the features of the independent claim. Advantageous developments are the subject matter of the dependent claims.

The vane machine according to the invention serves for the expansion or compression of gaseous media, such as, in particular, air, exhaust gases from an internal combustion engine with a temperature of up to 500° C., vaporous media or a mixture thereof. The housing has a cylindrical space and also an inlet port and an outlet port in the cylindrical space and a shaft displaced in parallel or arranged eccentrically with respect to the center axis of the housing. Furthermore, the vane machine has at least one first and one second circular disk, arranged so as to be offset in parallel with respect to one another on the shaft, and slides guided by the circular disks and displaceable in the direction of the inner wall of the housing, a vane cell being formed in each case by the participation of two adjacent slides of the adjacent region of the inner wall of the housing, and the volume of the vane cells in the region of the inlet port differing from the volume of the vane cells in the region of the outlet port. According to the invention, there is provision for each of the circular disks to have a plurality of circular-arcuate slots. Each of the slides has a circular-arcuate configuration at least at its end facing the housing of the vane machine. The circular-arcuate part of each slide moves in at least one circular-arcuate slot of a first circular disk and in a circular-arcuate slot of a second circular disk.

In a particularly preferred embodiment of the invention, each slide is guided in each case by at least two holding arms on a portion of a circular path and in at least two of the circular-arcuate slots.

The measures according to the invention make it possible to implement a vane machine which has a multiplicity of slides and therefore a multiplicity of chambers in a very confined space. Reliable guidance, without a tilting of the slides in the slots, is nevertheless ensured.

In a refinement of the invention, there is provision for the vane machine to have a compensating device which deflects each of the slides in the direction of the inner wall of the housing. This is achieved in that that end of the slide which faces the inner wall of the housing, despite its rotation about the eccentric axis of rotation of the shaft, describes a circular path about the center axis of the vane machine.

In a development of the vane machine according to the invention, there is provision for the compensating device to be dimensioned in such a way that that end of the slide which faces the inner wall of the housing slides closely, but contactlessly, past the inner wall of the housing of the vane machine.

In a refinement of the invention, there is provision for each of the slides to be provided with a guide arm and for the guide arm to have a guide bolt. The guide bolt is aligned with that end of the slide which faces the inner wall of the housing. The guide bolt rests, at its end facing away from the guide arm, in the single connecting rod bore of a connecting rod.

In a development of the invention, there is provision for the connecting rod to be provided with a connecting rod foot which is guided between the outermost and the innermost face of a circular ring.

In a refinement of the invention, there is provision for the compensating device to have a circular disk fastened on the eccentric shaft, and the circular ring. The circular ring is connected mechanically to the circular disk in such a way that the center of the circular ring lies on the center axis of the vane machine.

In one embodiment of the invention, there is provision for the circular disk and the circular ring to be connected mechanically to one another via one or more step-shaped connecting elements.

What can be achieved in a technically simple way by these measures according to the invention is that the slides slide contactlessly past the inside of the outer wall of the housing of the vane machine at a predetermined distance from said inside. The distance is preferably dimensioned such that only insignificant pressure compensation occurs via the gap between the slide and outer wall.

In a preferred refinement of the invention, there is provision for the holding arms of a first slide to be in each case fastened rotatably on the first side of the circular disks and for the holding arms of the second slide, directly adjacent to the first slide, to be in each case fastened rotatably on the second side of the circular disks.

The slides can thereby be brought together more closely, so that the dimensions of the vane machine can be further reduced.

BRIEF DESCRIPTION OF THE SEVERAL VIEWS OF THE DRAWING

The vane machine according to the invention is described in more detail below by means of an exemplary embodiment, using drawings which are not necessarily true to scale. The same reference symbols denote identical or identically acting elements. In the drawings.

DESCRIPTION OF THE INVENTION

Figure 1:
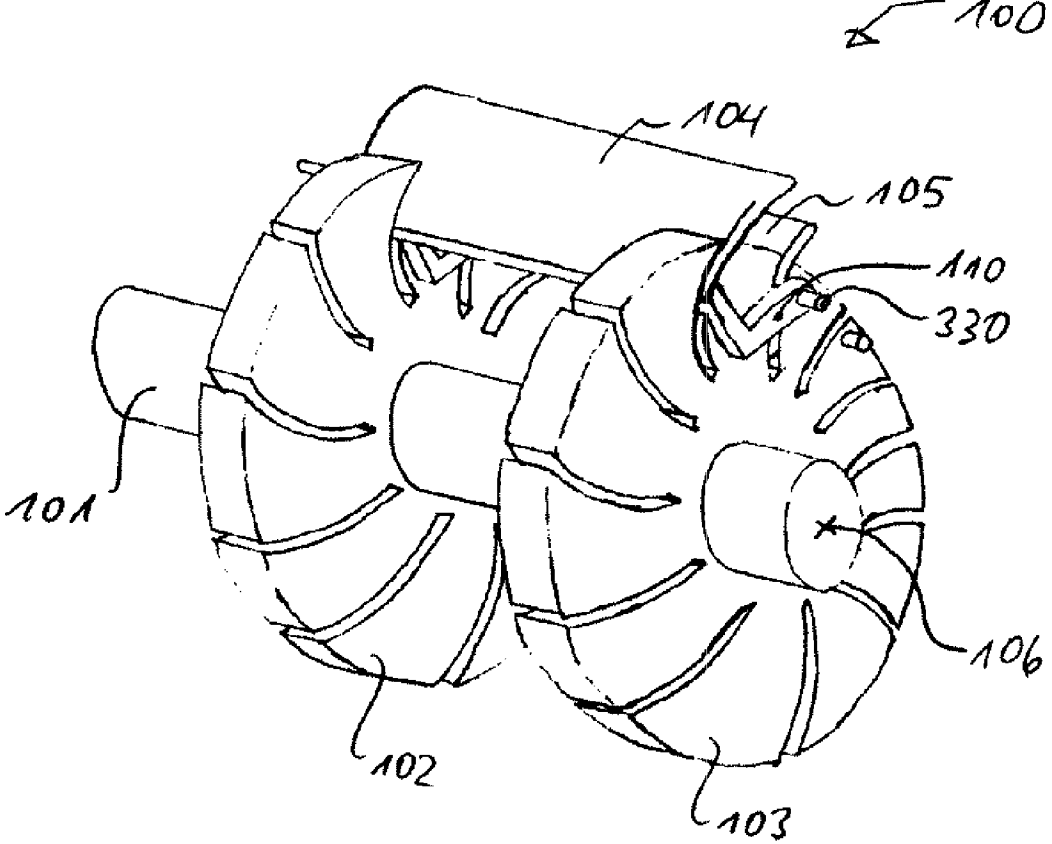
FIG. 1 shows a first part view of the vane machine according to the invention in a diagrammatic illustration.

The part view 100, illustrated in FIG. 1, of the vane machine 500 according to the invention in a perspective illustration and in diagrammatic form shows a shaft 101 arranged eccentrically in the vane machine illustrated below, a first circular disk 102 and a second circular disk 103. The first and the second circular disk 102 and 103 are identical and are "lined up", spaced apart, on the shaft 101. They are in each case fastened (not illustrated) fixedly in terms of rotation on the shaft 101. FIG. 1 illustrates by way of example only two slides 104 and 105 of twelve identical slides.

Figure 2:
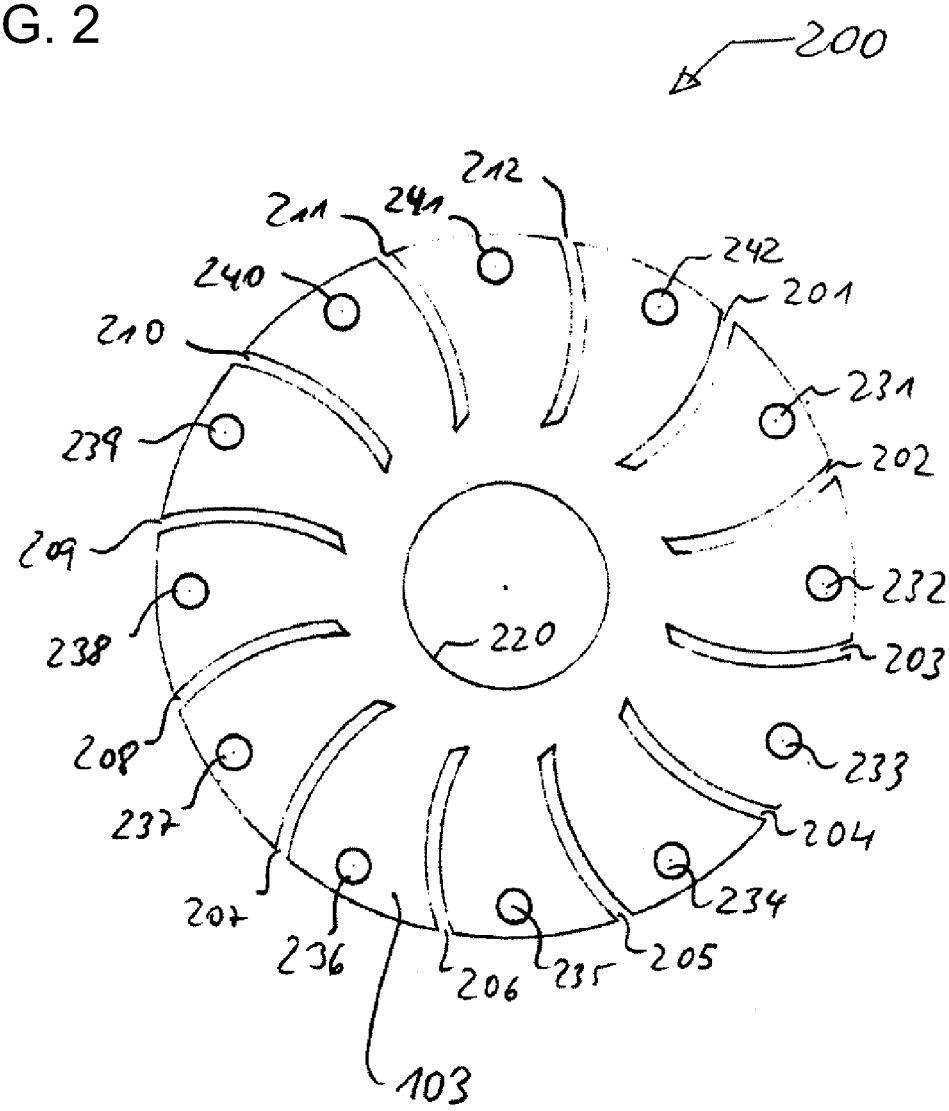
FIG. 2 shows the rear side of one of the circular disks illustrated in FIG. 1, in a diagrammatic illustration.

FIG. 2 shows the rear side 200 of the second circular disk 103 illustrated in FIG. 1. The circular disk 103 has slots 201 to 212 which are in each case closed toward the center of the circular disk and open toward the margin of the circular disk. The slots are in each case circular-arcuate and have the same dimensions. The twelve slots 201 to 212 are distributed uniformly on the circular disk 103, that is to say a slot in the circular disk 103 for receiving in each case an identical, likewise circular-arcuate slide or a slide of circular-arcuate cross section 104, 105, etc. is provided every 30 degrees. The circular disk 103 has at its center a bore 220 for receiving the shaft 101. In each case a bore 231 to 242 for fastening in each case a holding arm 110 etc. rotatable about the respective bore is provided between two circular-arcuate slots 201, 202, etc. The bores 231 to 242 have in each case the same diameter and run parallel to the bore 220.

Figure 3:
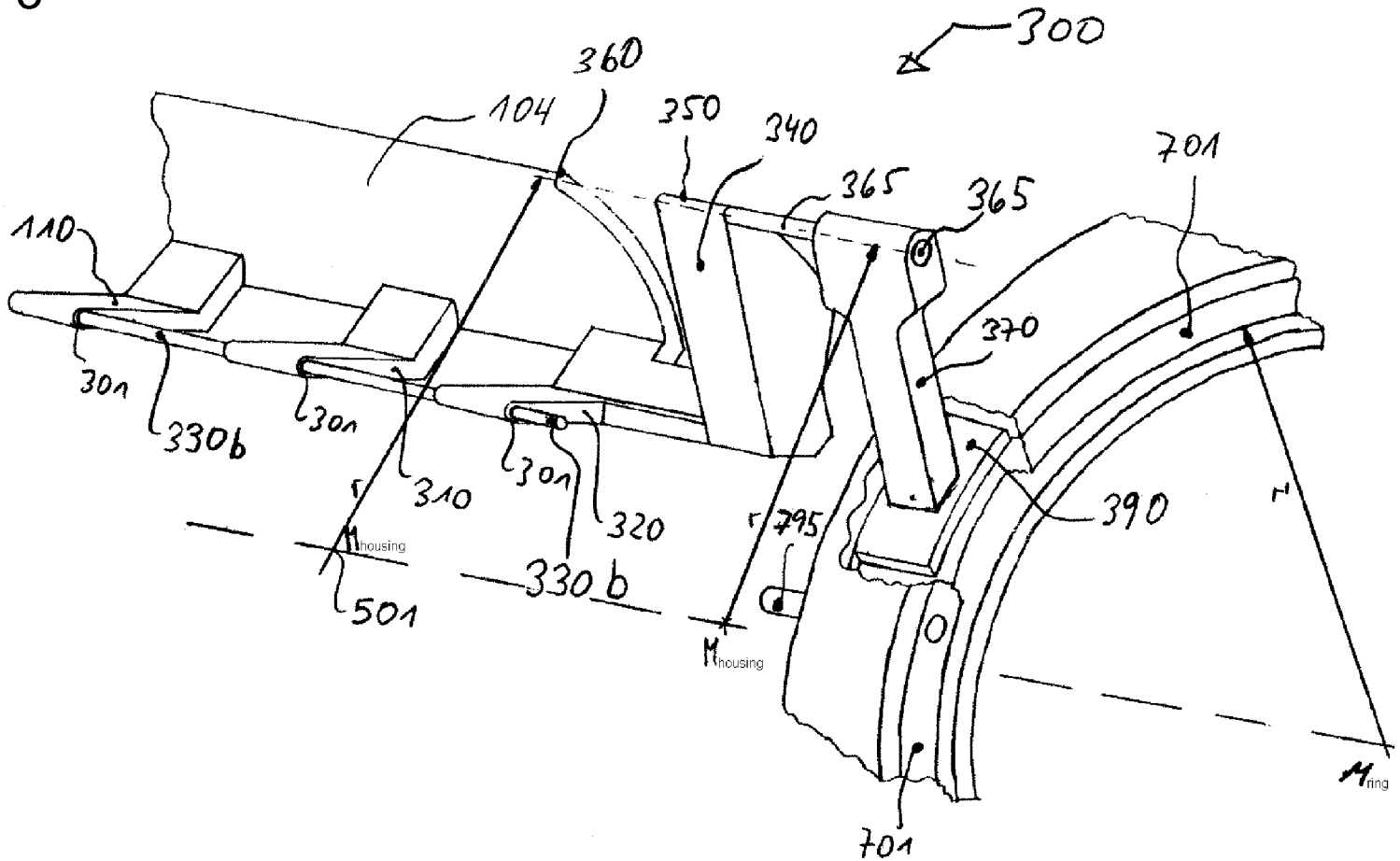
FIG. 3 shows a slide device with a circular-arcuate slide of FIG. 1 in a diagrammatic illustration in more detail.

FIG. 3 shows the circular-arcuate slide 104 or the slide device 300 of FIG. 1 in a diagrammatic illustration in more detail. All the other slides or slide devices which are not illustrated in FIG. 1 and are guided in the circular-arcuate slots 202 to 212 correspond to the slide 104 or the slide device 300, that is to say all the slides or slide devices are identical. The slide 104 or slide device 300 is guided between two adjacent circular-arcuate slots 212, located at the same height, of the circular disks 102 and 103 illustrated in FIG. 1. Three hook-shaped or elbowed holding arms 110, 310 and 320 are articulated at the first end on the circular-arcuate slide 104. At the end facing away from the circular-arcuate slide 104, the holding arms 110, 310 and 320 have in each case a through bore 301 which runs parallel to the slide 104 and which is pierced in each case by a round guide bar 330*b*. The center of each of the bores 301 and that end of the slide 104 which faces away from the holding arms 110, 310 and 320 are such that an imaginary radius vector r emanating from the center axis 501 of the vane machine 500 ends exactly at that end of the slide 104 which faces away from the holding arms 110, 310 and 320.

FIG. 1 illustrates by way of example a single holding arm 110 which has a hook-shaped or elbowed form and which is fastened at its first end to the slide 104. The second end of the holding arm 110 has a bore 301 which has the same diameter as the bores 231 to 242. The guide bar 330*b*, which has a circular cross section, engages through the bores 240 and 301. When the vane machine 500 is in operation, the slide 104 moves around the guide bar 330*b* and along a portion of a circular path, the center of which lies in the center axis of the guide bar 330*b*. The slide 104 is guided along the portion of the circular path by the holding arms 110, 310, 320, etc. (cf. FIG. 3) and, because of the holding arms, moves, without tilting, in the circular-arcuate slots 212, etc. (cf. FIGS. 1 and 2). The same also applies correspondingly to the other slides in a similar way.

Figure 4:
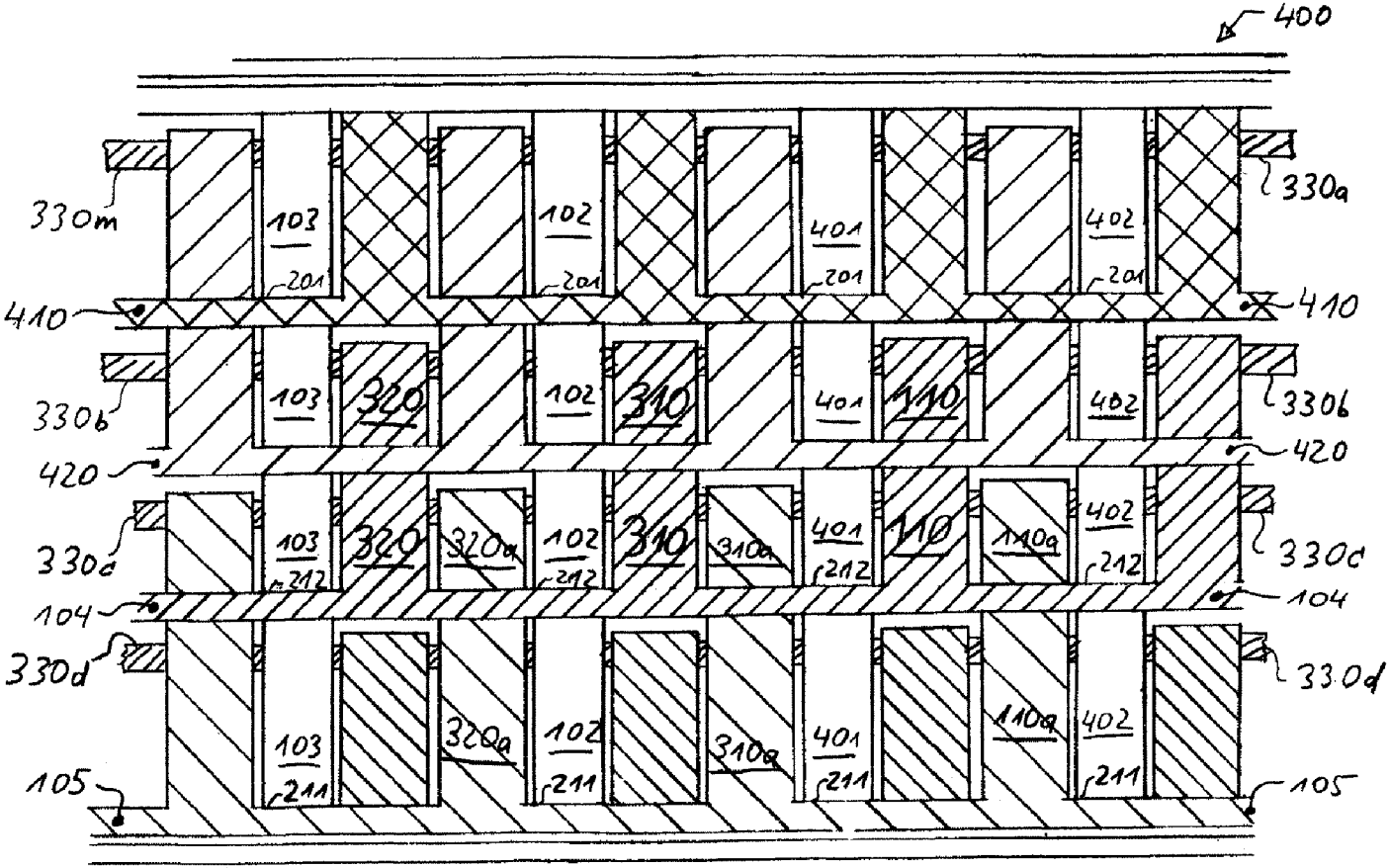
FIG. 4 shows a diagrammatic longitudinal section in the region between the two slides illustrated in FIG. 1.

FIG. 4 shows a diagrammatic longitudinal section 400, parallel to the longitudinal axis of the shaft 101, in the region between the two slides 104 and 105 illustrated in FIG. 1.

On account of the holding arms, the slide 104 moves, without tilting, in the circular-arcuate slots 212 of the circular disks 102, 103 and of further circular disks 401 and 402 not illustrated in FIG. 1. The circular disks 401 and 402 are identical to the circular disks 102 and 103. The holding arms 110, 310 and 320 illustrated in FIG. 3 are provided on the slide 104. At their end facing away from the slide 104, the holding arms 110, 310 and 320 have in each case the bore 301, not illustrated in FIG. 4. The bores 301 of the holding arms 110, 310, 320 are penetrated by the guide bar 330*b*. The guide bar 330*b* absorbs the forces of the slide and, furthermore, penetrates the bore 240 of the circular disk 103 and the corresponding bores in the circular disks 102, 401 and 402.

The slide 105, on account of the corresponding holding arms (not illustrated), moves, without tilting, in the circular-arcuate slots 211 of the circular disks 102, 103 and the circular disks 401 and 402. Holding arms 110*a*, 310*a* and 320*a* corresponding to the slide 104 are provided on the slide 105. At their end facing away from the slide 105, the holding arms 110*a*, 310*a* and 320*a* have in each case the bore 301, not illustrated in FIG. 4. The bores 301 not illustrated in FIG. 4, of the holding arms 110*a*, 310*a*, 320*a* are penetrated by the guide bar 330*c*. The guide bar 330*c*, furthermore, penetrates the bore 239 of the circular disk 103 and the corresponding bores in the circular disks 102, 401 and 402.

Furthermore, FIG. 4 also illustrates completely or partially slides 410 and 420 and their holding arms. These correspond to the slides and holding arms already described.

It is particularly clear from FIG. 4 that, with a shaft 101 of appropriate length, the vane machine 500 according to the invention can also be extended in the longitudinal direction in a highly flexible way and can therefore be adapted in a simple way to the mechanical power actually to be furnished. This is achieved by lining up a corresponding number of spaced-apart circular disks on the shaft 101 and by selecting slides of corresponding length. Furthermore, the mechanical power to be furnished by the vane machine according to the invention can be adapted in a flexible way to the actual requirements by enlarging or reducing the diameter of the circular disks and/or by increasing or reducing the number of slides on the circular disks.

The slides are not exposed to any flank load on account of the holding arms used. This, in conjunction with the clearance of the slides in the circular-arcuate slots, lowers the wear and consequently increases the service life and the efficiency.

Figure 5:
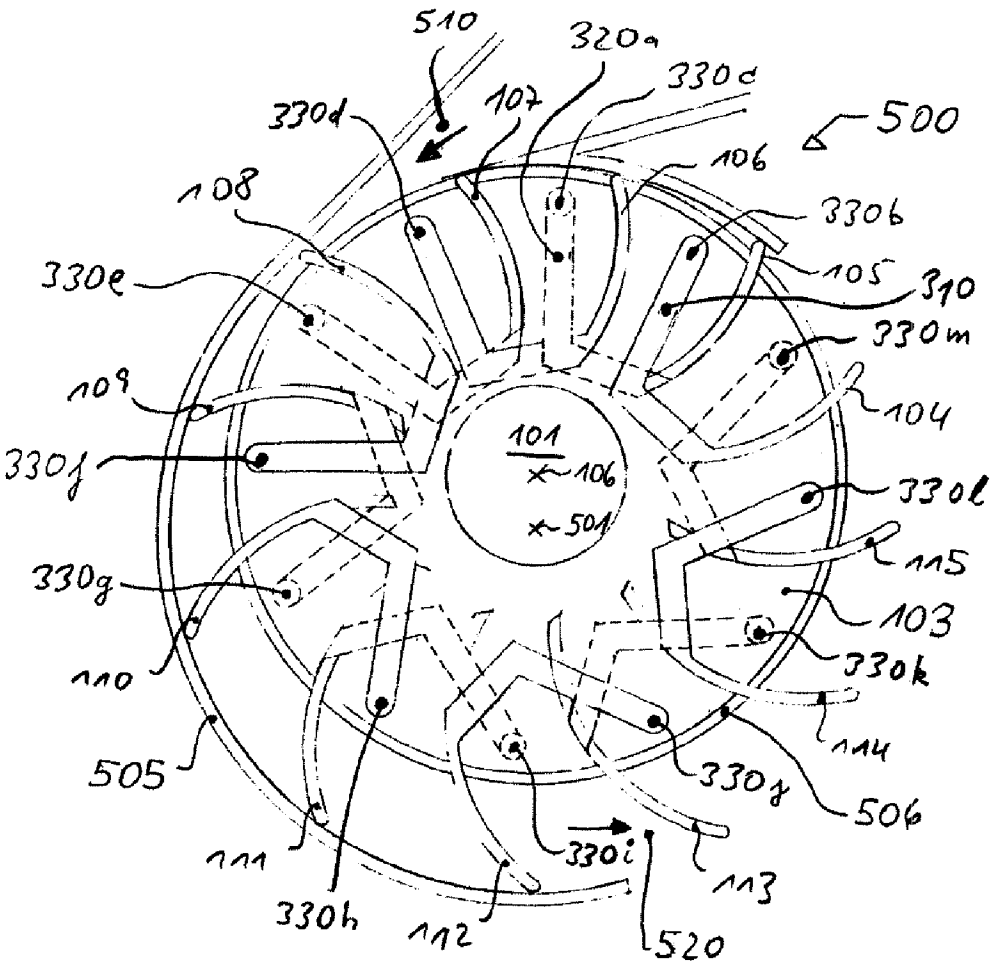
FIG. 5 shows a diagrammatic section through a vane machine according to the invention in the region of a circular disk.

FIG. 5 shows a diagrammatic section through a vane machine 500 according to the invention transversely to the shaft 101 in the region of the circular disk 103 illustrated in FIG. 1. FIG. 5 illustrates the vane machine 500, the circular disk 103, circular-arcuate slides 104 to 115 which are located with clearance in circular-arcuate slots 201 to 212 (partially illustrated), the holding arms 310, 320*a*, etc. of the circular-arcuate slides 104, 105, etc. in the region of the circular disk 103, the shaft 101 arranged eccentrically in the vane machine, the axis of rotation 106 of the shaft 101, the center axis 501 of the vane machine 500, the guide bars 330*b* to 330*m*, the outer wall 505 and the inner wall 506 of the vane machine 500 with ducts for oil lubrication and sealing for the circular-arcuate slides 104, 105, etc.

The twelve holding arms 310, 320*a*, etc., illustrated in FIG. 5, of the twelve slides 104 to 115 are located alternatively above and below the circular disk 103. This also applies correspondingly to the holding arms and the slides 104 to 115 in the region of the circular disk 102 and the further circular disks 401 and 402, as indicated in FIG. 4 (the guide bars 330*d*, 330*c*, 330*b* and 330*m* illustrated in FIG. 4 are in actual fact not located in the same sectional plane, but lie in different planes, as can directly be seen particularly from FIG. 2). What is advantageously achieved thereby is that even directly adjacent slides and their holding arms do not impede one another during the movement of the associated slides and therefore a large number of slides can be provided on the circular disks. This makes it possible to have a vane machine of small build with compact dimensions, but with a large number of expansion or compression chambers which are formed in each case between two directly adjacent slides, the adjoining outer wall 505 and the adjoining inner wall 506 of the vane machine 500.

A gas or gas mixture flowing into the inlet port 510 of the vane machine 500 rotates the circular disks and the circular-arcuate slides which are guided by them, the concave side of which points in each case in the direction of the inflowing gas or gas mixture, and at the same time drives the shaft 101 in order to perform mechanical work or to generate electrical work (not illustrated). On account of the eccentric arrangement of the shaft 101 in relation to the center axis 501 of the vane machine 500, the distance between the inner wall 506 and the outer wall 505 of the vane machine 500 increases. Consequently, the volume enclosed between two adjacent slides on the way from the inlet port 510 to the outlet port 520 is enlarged, and the gas or gas mixture is expanded on its way. The slides and their holding arms at the same time pivot in each case along a portion of a circular path, about the guide bar assigned to them and come to bear against the inside of the outer wall 505.

Figure 6:
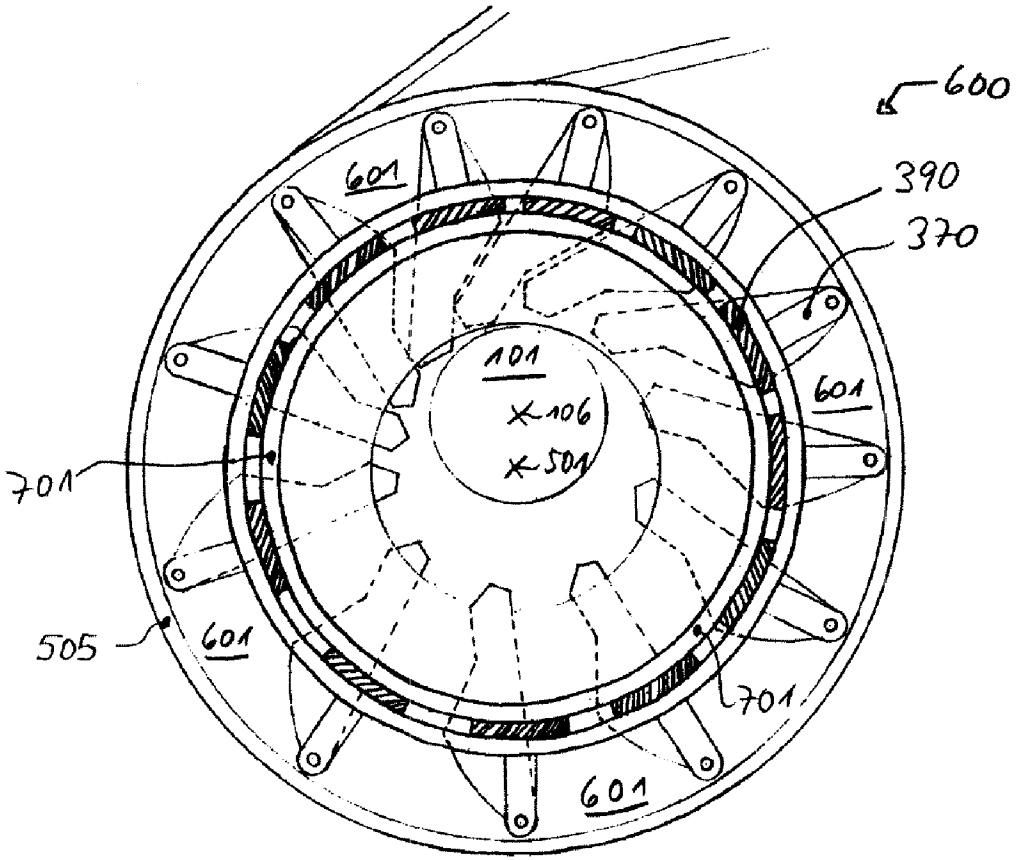
FIG. 6 shows a diagrammatic section through the vane machine according to the invention in the region of a centrically arranged circular ring.

How the slides 104 to 115 are brought closely to the inside of the outer wall 506, but without touching it, is described below with reference to FIGS. 3, 6 and 7. A close, but contactless, guidance of the slides against the inside of the outer wall 506 is important in order to allow an undisturbed friction-free rotation of the circular disks, along with low pressure losses via the gap between the inside of the outer wall 506 and the respective slides toward the pressure chamber which is next in the direction of rotation. A pressure chamber is located in each case between two adjacent slides.

As illustrated in FIG. 3, the slide devices 300 according to the invention have, furthermore, a guide arm 340 which is attached to the elbowed part of the holding arm 320 and the second end 350 of which is in alignment with the end of the slide 104. Between the slide 105 and the guide arm is located the separation plate 601, illustrated in FIG. 6, which closes the vane machine 500 toward one end. FIG. 6 shows a diagrammatic section 600 through the vane machine 500 according to the invention in the region of a centrically arranged circular ring 701. Furthermore, a further separation plate (not illustrated) is provided at the other end of the slide 104 or else at the other ends of the other sides. Like the other slides according to the invention, the slide 104 has a circular-arcuately rounded end 360. The guide arm 340 has at its second end 350 a bore (not illustrated) in which the first end of a guide bolt 365 is located. The other end of the guide bolt 365 having a circular cross section is located in a bore of a connecting rod 370 said bore being located at the second end of the connecting rod 370. The center axis of the guide bolt 365 is at the same distance r from the center axis 501 of the vane machine 500 or from the center of the housing $M_{housing}$ as the center axis of the circular-arcuately rounded end 360 of the slide 104, the center axis of the circular-arcuately rounded end 360 and the center axis of the guide bolt 365 being aligned with one another, that is to say lying at the same height.

In order to impart to the slide 104 or its rounded end 360 and correspondingly to the further slides according to the invention a centric movement along the inside of the outer wall 505 of the vane machine 500, even though the slides 104, etc. run on circular disks 102, 103, 401 and 402 etc. arranged eccentrically in the vane machine 500, a compensating device 700 is provided according to the invention.

Figure 7:
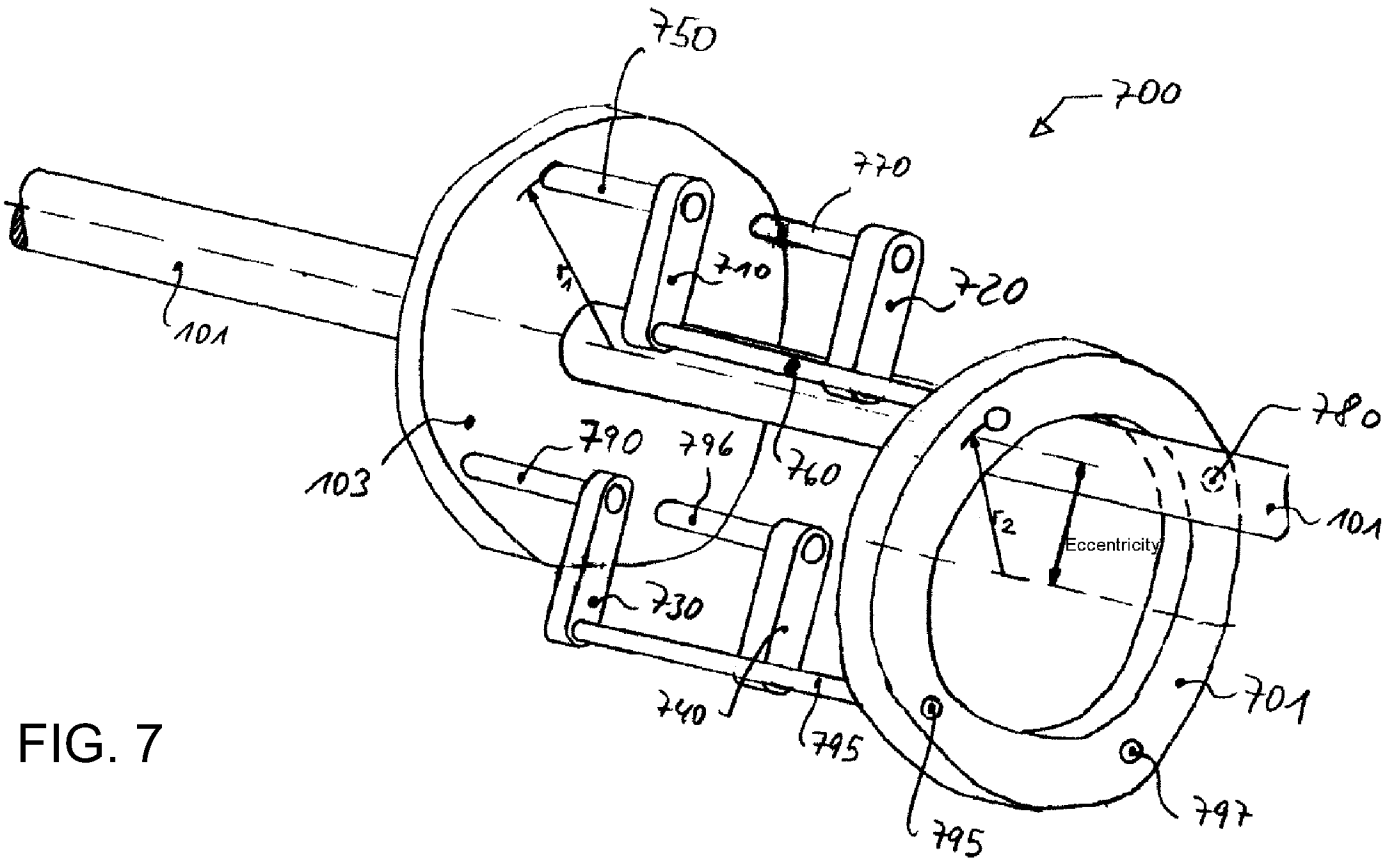
FIG. 7 shows a compensating device according to the invention with the centrically arranged circular ring.

The compensating device 700, illustrated in FIG. 7 has four compensating arms 710, 720, 730 and 740. Each of the compensating arms has a bore (not illustrated) at its two ends. Located in the first bore of the holding arm 710 is a holding pin 750 which connects the holding arm 710 mechanically to the circular disk 103. The circular disk 103 has a first bore (not illustrated) for receiving the other end of the holding pin 750. The center of the first bore is at a distance $r_1$ from the center axis of the eccentric shaft 101.

Located in the second bore of the holding arm 710 is the first end of a further holding pin 760, the other end of which is inserted in a first bore (not illustrated) of a circular ring 701. The center of the first bore of the circular ring 701 is at a distance $r_2$ from the center of the ring. Correspondingly, the holding arms 720, 730 and 740 connect, via holding pins 770, 780; 790, 795; 796, 797 assigned to them, the circular disk 103 to the circular ring 701, so that the circular ring 701 rotates at the same angle of rotation as the circular disk 103, the circular disk 103 rotating about the eccentric axis of rotation 106 of the shaft 101 and the circular ring 701 rotating about the center axis 501 of the vane machine 500.

The foot 390 of the connecting rod 370 is supported on the ring surface of the circular ring 701, the longitudinal clearance (not illustrated) allowing a limited tangential movement of the foot 390 on the surface of the circular ring 701, and the foot 390 otherwise following the surface of the circular ring 701, on which surface the foot 390 is supported both outwardly and inwardly. The connecting rod 370 consequently imparts to the rounded end 360 of the slide 104 a movement about the center axis 501 of the vane machine 500, and the rounded end 360 of the slide 104 remains at a predetermined distance from the inside of the outer wall 505. The same applies correspondingly to the other slides on account of the identically acting other connecting rods which, however, have not been given reference symbols in FIG. 6 for the sake of clarity. By virtue of the identically acting other connecting rods, the individual centrifugal forces of the slides act counter to one another and therefore for the most part cancel one another.

LIST OF REFERENCE SYMBOLS

100 part view of the vane machine according to the invention
101 shaft arranged eccentrically with respect to the center axis of the vane machine
102 circular disk
103 circular disk
104 to 115 slides of circular-arcuate cross section
106 axis of rotation of the shaft 101
110 one of a plurality of elbowed holding arms of the slide 104
200 the rear side of the second circular disk 103 illustrated in FIG. 1
201 to 212 circular-arcuate slots for the complete or partial reception of one of the slides in each case
220 bore of the circular disk for the rotationally fixed reception of the shaft 101
231 to 242 bore in each case for fastening a holding arm 110 rotatable about the respective bore
300 slide device
301 through bores running parallel to the slide 104 through the holding arms of the slide
310 elbowed holding arm
320 elbowed holding arm
330*b* to 330*m* guide bars of the slides
340 guide arm
350 second end of the guide arm
360 circular-arcuately rounded end of each slide
365 guide bolt r the radial distance between the centric center axis 501 of the vane machine or of the housing of the vane machine and the center axis of the circular-arcuately rounded end 360 of the slide

370 connecting rod

390 foot of the connecting rod r' the radial distance between the center of the circular ring 701 and the surface of the circular ring on which the foot of the connecting rod lies

400 diagrammatic longitudinal section, parallel to the longitudinal axis of the shaft 101, in the region between the two slides 104 and 105 illustrated in FIG. 1

401 circular disk

402 circular disk

410 slide

420 slide

500 vane machine

501 center axis of the vane machine

505 outer wall of the vane machine

506 inner wall of the vane machine

510 inlet port of the vane machine

520 outlet port of the vane machine

600 diagrammatic section through the vane machine according to the invention in the region of a centrically arranged circular ring 701

601 separation plate

700 compensating device

701 circular ring $r_1$ the radial distance between the center axis of the eccentrically arranged shaft 101 and the center of the bore in the circular disk 103 for receiving the holding pin 750

$r_2$ the radial distance between the center axis of the centrically arranged circular ring 701 and the center of the bore in the circular ring 701 for receiving the holding pin 760

710 compensating arm

720 compensating arm

730 compensating arm

740 compensating arm

750 holding pin

760 holding pin

770 holding pin

780 holding pin

790 holding pin

795 holding pin

796 holding pin

797 holding pin

The invention claimed is:

1. A vane machine for expansion or compression of gaseous media, air, exhaust gases from an internal combustion engine, vaporous media or a mixture thereof, the vane machine comprising:

a housing including an inner wall defining a center axis and a cylindrical space and having an inlet port and an outlet port in said cylindrical space;

a shaft displaced in parallel or disposed eccentrically relative to said center axis;

at least one first and one second circular disk disposed offset in parallel relative to one another on said shaft, each of said circular disks having a plurality of circular-arcuate slots;

a connecting rod having a single connecting rod bore;

slides guided by said circular disks and displaceable in direction of said inner wall, each of said slides having an end facing said inner wall and a part with a circular-arcuate configuration at least at said end facing said inner wall, said circular-arcuate part of each of said slides moving at least in one of said circular-arcuate slots of said first circular disk and in one of said circular-arcuate slots of said second circular disk, each of said slides having a guide arm with a guide bolt aligned with said end of said slide facing said inner wall, and said guide bolt having an end facing away from said guide arm and resting in said single connecting rod bore; and vane cells each being formed by an adjacent two of said slides and an adjacent region of said inner wall, said vane cells having volumes, and said volume of said vane cells in vicinity of said inlet port differing from said volume of said vane cells in vicinity of said outlet port.

2. The vane machine according to claim 1, which further comprises at least two holding arms guiding each respective slide on a portion of a circular path and in at least two of said circular-arcuate slots.

3. A vane machine for expansion or compression of gaseous media, air, exhaust gases from an internal combustion engine, vaporous media or a mixture thereof, the vane machine comprising:

a housing including an inner wall defining a center axis and a cylindrical space and having an inlet port and an outlet port in said cylindrical space;

a shaft displaced in parallel or disposed eccentrically relative to said center axis;

at least one first and one second circular disk disposed offset in parallel relative to one another on said shaft, each of said circular disks having a plurality of circular-arcuate slots;

slides guided by said circular disks and displaceable in direction of said inner wall, each of said slides having an end facing said housing and a part with a circular-arcuate configuration at least at said end facing said housing, said circular-arcuate part of each of said slides moving at least in one of said circular-arcuate slots of said first circular disk and in one of said circular-arcuate slots of said second circular disk;

vane cells each being formed by an adjacent two of said slides and an adjacent region of said inner wall, said vane cells having volumes, and said volume of said vane cells in vicinity of said inlet port differing from said volume of said vane cells in vicinity of said outlet port;

a circular ring having an outermost face and a center;

a connecting rod having a connecting rod foot lying on said outermost face of said circular ring;

a compensating device deflecting each of said slides in direction of said inner wall causing said end of said slide facing said inner wall, despite its rotation about an eccentric axis of rotation of said shaft, to describe a circular path about said center axis, said compensating device having a circular disk fastened on said eccentric shaft and said circular ring; and said circular ring being connected mechanically to said circular disk with said center of said circular ring lying on said center axis.

4. The vane machine according to claim 3, wherein said compensating device is dimensioned to cause said end of said slide facing said inner wall to slide closely, but contactlessly, past said inner wall.

5. The vane machine according to claim 3, which further comprises at least one step-shaped connecting element mechanically interconnecting said circular disk and said circular ring.

6. A vane machine for expansion or compression of gaseous media, air, exhaust gases from an internal combustion engine, vaporous media or a mixture thereof, the vane machine comprising:

a housing including an inner wall defining a center axis and a cylindrical space and having an inlet port and an outlet port in said cylindrical space;

a shaft displaced in parallel or disposed eccentrically relative to said center axis;

at least one first and one second circular disk disposed offset in parallel relative to one another on said shaft, each of said circular disks having first and second sides and a plurality of circular-arcuate slots;

slides guided by said circular disks and displaceable in direction of said inner wall, each of said slides having an end facing said housing and a part with a circular-arcuate configuration at least at said end facing said housing, said circular-arcuate part of each of said slides moving at least in one of said circular-arcuate slots of said first circular disk and in one of said circular-arcuate slots of said second circular disk, said slides having holding arms, said holding arms of a first one of said slides each being fastened rotatably on said first side of said circular disks, and said holding arms of a second one of said slides, directly adjacent said first one of said slides, each being fastened rotatably on said second side of said circular disks; and vane cells each being formed by an adjacent two of said slides and an adjacent region of said inner wall, said vane cells having volumes, and said volume of said vane cells in vicinity of said inlet port differing from said volume of said vane cells in vicinity of said outlet port.

* * * * *